US005966949A

United States Patent [19]

Futagami et al.

[11] Patent Number: 5,966,949

[45] Date of Patent: Oct. 19, 1999

[54] COMPRESSOR FOR REFRIGERATING MACHINE

[75] Inventors: Yoshiyuki Futagami, Hyogo; Hideo Hirano; Hiroyuki Kawano, both of Shiga, all of Japan

[73] Assignee: Matsushita Electric Industrial Co., Ltd., Osaka, Japan

[21] Appl. No.: 08/854,036

[22] Filed: May 9, 1997

[30] Foreign Application Priority Data

May 10, 1996 [JP] Japan ..... 8-116042

[51] Int. Cl.[6] ..... F25B 41/00

[52] U.S. Cl. ..... 62/114; 252/68

[58] Field of Search ..... 62/114, 468, 470, 62/472; 252/68

[56] References Cited

FOREIGN PATENT DOCUMENTS 6-240285 8/1994 Japan .

*Primary Examiner*—Henry Bennett
*Assistant Examiner*—Malik N. Drake
*Attorney, Agent, or Firm*—McDermott, Will & Emery

[57] ABSTRACT

To present a compressor for refrigerating machine excellent in lubricating effect, small in wear of contact portions, outstanding in refrigerating performance, and high in reliability, in a compressor using HFC refrigerant not containing chlorine atom. A lubricating oil containing HFC refrigerant, an ester compound oil as principal component, and a phosphoric acid triester as extreme pressure additive is used. Moreover it is composed so that the surface hardness of a vane for composing the contact portions of the compressing mechanism and the surface hardness of the piston may have a difference of 10 or more in Rockwell hardness (HRC). As the extreme pressure additive, also, phosphite, phosphoric acid diester or phosphoric acid monoester can be used. As the principal component of lubricating oil, ether compound oil or carbonate compound oil is also usable.

44 Claims, 6 Drawing Sheets

COMPRESSOR FOR REFRIGERATING MACHINE

TECHNICAL FIELD OF THE INVENTION

The present invention relates to a compressor for refrigerating machine disposing a compressing mechanism within an enclosed container, and more particularly to a compressor for refrigerating machine using a refrigerant of hydrofluorocarbon system not containing chlorine.

BACKGROUND OF THE INVENTION

Compressors for refrigerating machine disposing a compressing mechanism within an enclosed container, or so-called enclosed type compressors are roughly classified into rotary type, reciprocating type, and scroll type. In any part, in the area exposed to the refrigerant, there is a contact portion in which metal members contact with each other. The vanes and pistons are formed of various materials such as cast iron and aluminum alloy.

On the other hand, in the refrigerants used hitherto, such as chlorofluorocarbons (CFCs) and hydrochlorofluorocarbons (HCFCs), for example, CFC11, CFC12, HCFC22, chlorine atoms are contained in molecules, and the chlorine is known to induce depletion of ozone layer, and substituent refrigerants are being developed and used.

Highly practicable substituent refrigerants include chlorine-free hydrofluorocarbons (HFCs) (Hydraulic and Pneumatic Technology, No. 6, 1994, published by Nippon Kogyo Shuppan).

When using such substituent refrigerants, for example, R134*a*, R125, R32, since the substituent refrigerants do not contain chlorine which has an extreme pressure effect, such lubricity as recognized in the conventional designated CFCs and designated HCFCs is not expected. Accordingly, the contact condition becomes severe, and the oil film may be partly broken in the contact area, and a boundary lubrication state is likely to occur. In this area of boundary lubrication state, sticking occurs between both contact members in the contact area to cause early wear or seizure, which leads to lowering of refrigerating performance and decline of reliability. In the compressor for refrigerating machine of the conventional rotary type, abrasion is extreme between the tip of the vane and the outer periphery of the piston.

The lubricating oil as the refrigerating machine oil when using such substitute refrigerant is particularly required to have compatibility of refrigerant and lubricating oil, from the viewpoint of lubrication for bringing in and supplying the lubricating oil into parts of the compressor by the flow of refrigerant and from the viewpoint of efficiency of heat exchange. When using conventional refrigerants such as CFCs and HCFCs, mineral oil or alkyl benzene was widely used as lubricating oil, but such lubricating oil is extremely poor in compatibility with such substitute refrigerant, and it has been considered to use ester compound oil having compatibility with substitute refrigerant (Hydraulic and Pneumatic Technology, No. 6 , 1994, published by Nippon Kogyo Shuppan).

However, since the ester compound oil has a polar group and is high in moisture absorption, the absorbed moisture decomposes the ester compound oil to produce carboxylic acid. This carboxylic acid corrodes the surface of the contact members, and lowers the fatigue reliability of the contact members (Hydraulic and Pneumatic Technology, No. 6, 1994, published by Nippon Kogyo Shuppan). Moreover, by decomposition of ester compound oil, hydrogen is produced, and this hydrogen invades into the contact members to cause hydrogen brittleness or stress corrosion, which results in decline of reliability of contact members. The ester compound pound oil also produces metal soap by hydrolysis and forms sludge, and this sludge clogs the capillary tube to cause adverse effects on the refrigerating cycle.

To solve such problems, it may be considered to add proper additives to the lubricating oil for preventing such undesired reaction and enhancing the lubricity of the contact area. Despite various studies, sufficient effects are not obtained, and further improvements are expected.

It is hence an object of the invention to solve such problems and present a compressor for refrigerating machine having a high refrigerating performance and an extremely high reliability.

SUMMARY OF THE INVENTION

The compressor for refrigerating machine of the invention comprises an enclosed container, a compressing mechanism having contact portions, being installed in the enclosed container, refrigerant contained in the enclosed container, and lubricating oil compatible with the refrigerant. The refrigerant is a hydrofluorocarbon (HFC) not containing chlorine atom in its chemical structure. The lubricating oil contains an ester compound oil and at least one phosphorus compound selected from the group consisting of phosphoric acid triester, phosphite, phosphoric acid diester, and phosphoric acid monoester.

In this constitution, the phosphorus compounds such as phosphoric acid triester, phosphite, phosphoric acid diester, and phosphoric acid monoester exhibit the action as extreme pressure additives, and compensate for shortage of lubrication due to chlorine-free composition of HRC refrigerant, and thereby enhance the lubricity of the HRC refrigerant. Moreover, suppressing hydrolysis of ester compound oil, the surface of the contact members having a small hardness is protected from corrosion effects. Accordingly, abrasion of both contact member having a high hardness and contact member having a small hardness can be extremely reduced. Furthermore, formation of metal soap due to hydrolysis of ester compound oil is prevented, and it prevents the defect of clogging of capillary tube in the refrigerating cycle due to collection of sludge caused by metal soap. As a result, a compressor having a high reliability and an excellent refrigerating performance is obtained.

In the constitution, preferably, the contact portions include a first contact member and a second contact member, and the difference between hardness of surface of the first contact member and hardness of surface of the second contact member is 10 or more in Rockwell hardness (HRC).

In this constitution, in addition to the above effects, the following effects are brought about. The member having smaller hardness assures normal wear resistance by the ordinary hardness, while the other member having greater hardness can enhance the wear resistance outstandingly from the conventional level. That is, the wear resistance is improved in the necessary area of the metal contact portions. As a result, a compressor having a higher reliability and a more excellent refrigerating performance is obtained.

Preferably, the content X (wt.%) of the phosphoric acid triester contained in the lubricating oil is in a range of $0.2 \leqq X < 3.0$. In this constitution, particularly excellent effects as mentioned above are obtained even in the presence of an ester compound oil of a strong polarity.

Preferably, the lubricating oil further contains an acid capturing agent. The acid capturing agent is preferably an epoxy compound. The relation between the content Y (wt. %) of the acid capturing agent and the content X (wt. %) of the phosphoric acid triester is preferably $3+Y \times 0.714 > X \geqq 0.2+Y \times 0.714$, and $Y \leqq 1.4 (X-0.2)$.

In this constitution, hydrolysis caused by moisture contained in the ester compound oil can be suppressed. In addition, total oxidation is decreased, and deterioration of lubricating oil can be prevented without causing other problems. The lubricating performance of contact portions can be maintained for a long period. It is further possible to prevent sufficiently decline of insulation and sealing performance due to corrosion of compressing mechanism installed in an enclosed container, insulating materials of motor, and organic members such as sealing materials, by organic acids. As a result, the refrigerating performance and reliability can be further enhanced.

Preferably, the lubricating oil further contains an antioxidant. The antioxidant is preferably a phenol compound. The relation between the content Z (wt.%) of the antioxidant and the content X (wt. %) of the phosphoric acid triester is preferably $3+Z \times 0.333 > X \geqq 0.2 + Z \times 0.333$, and $Z \leqq 3 (X-0.2)$.

In this constitution, oxidation of the lubricating oil due to dissolved oxygen in the ester compound oil can be prevented without causing other problems. Still more, the favorable lubricating performance of the contact portions can be maintained for a long period. As a result, the refrigerating performance and reliability can be further enhanced.

Preferably, further, acid capturing agent and antioxidant are contained. In this constitution, refrigerating performance and reliability can be further enhanced.

Preferably, the content of the phosphite contained in the lubricating oil is 0.09 wt.% or less. In this constitution, in an initial phase of operation of the compressor, fitting of the contact portions is improved, so that the lubricity may be enhanced. Moreover, afterwards, effects of acid on the ester compound oil are prevented. Therefore, without causing other problems, the initial lubricating performance of the contact portions is enhanced, and abrasion of contact portions in the initial phase of operation likely to cause abrasion can be prevented. As a result, the refrigerating performance and reliability can be further enhanced.

Preferably, the content of the phosphoric acid diester or phosphoric acid monoester contained in the lubricating oil is 0.03 wt.% or less. In this constitution, in an initial phase of operation of the compressor, fitting of the contact portions is improved, so that the lubricity may be enhanced. Moreover, afterwards, effects of acid on the ester compound oil are prevented. Therefore, without causing other problems, the initial lubricating performance of the contact portions is enhanced, and abrasion of contact portions in the initial phase of operation likely to cause abrasion can be prevented. As a result, the refrigerating performance and reliability can be further enhanced.

Other compressor for refrigerating machine of the invention comprises an enclosed container, a compressing mechanism having contact portions, being installed in the enclosed container, refrigerant contained in the enclosed container, and lubricating oil compatible with the refrigerant. The refrigerant is a hydrofluorocarbon (HFC) not containing chlorine atom in its chemical structure. The lubricating oil contains an ether compound oil and at least one phosphorus compound selected from the group consisting of phosphoric acid triester, phosphite, phosphoric acid diester, and phosphoric acid monoester.

In this constitution, the wear of the contact members is decreased regardless of the hardness of the surface of both contact members of the contact portions. Without using acid capturing agent, hydrolysis of lubricating oil can be suppressed. Moreover, clogging of capillary tube due to sludge caused by formation of metal soap is prevented. Corrosion of contact portions is prevented. Further, the action of phosphorus compound as extreme pressure additive compensates for shortage of lubrication of HFC refrigerant. As a result, practicably high refrigerating performance and high reliability are obtained.

Reference Numerals

Figure 1:
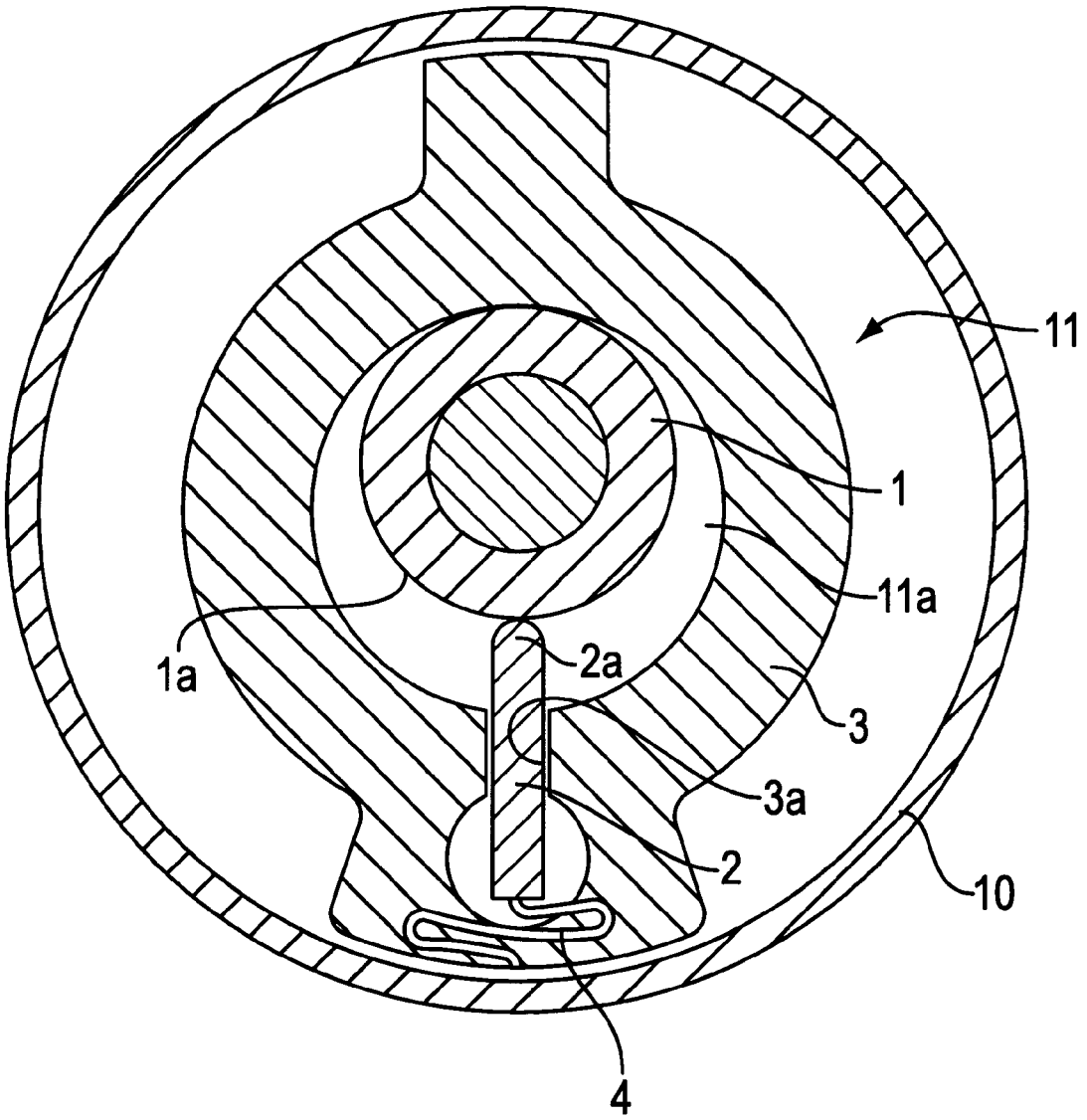
FIG. 1 is a cross sectional view of a compressor for refrigerating machine in an embodiment of the invention.

1 Roller piston
1*a* Outer periphery of piston
2 Vane
2*a* Tip of vane
3 Casing
3*a* Guide groove
4 Spring
10 Enclosed container
11 Compressing mechanism
11*a* Compressing chamber
20 Enclosed container
21 Disk for test
22 Vane for test
24 Drive shaft
25 Jig
26 Load shaft
27 Load
28 Lubricating oil
29 Refrigerant
30 Thermometer
31 Viscometer

DESCRIPTION OF THE PREFERRED EMBODIMENTS

Referring now to the drawings, preferred embodiments of the compressor for refrigerating machine of the invention are described in detail below.

EMBODIMENT 1

Embodiment 1 is a compressor for refrigerating machine of rotary type. A sectional view of the compressor for refrigerating machine of this embodiment is shown in FIG. 1. In FIG. 1, a compressing mechanism 11 is installed in an enclosed container 10 together with a motor (not shown).

The compressing mechanism 11 includes a roller piston 11 and a vane 2 installed in a. casing 3. The roller piston 1 is driven by the motor. The vane 2 slides inside of a guide groove 3*a* formed in the casing 3 by the rotation of the roller piston 1. A spring 4 to cause the vane 2 to follow the roller piston 1 is disposed between the vane 2 and casing 3. The refrigerating cycle in the enclosed container 10 is packed with refrigerant. The refrigerant is a chlorine-free substitute refrigerant, hydrofluorocarbon (HFC) refrigerant, such as HFC134*a*, HFC124, or HFC32. A lubricating oil compatible with the substitute refrigerant is stored in an oil sump (not shown) in the enclosed container 10. As the lubricating oil, an ester compound oil is used.

In this constitution, the roller piston 1 is driven, and is rotated eccentrically. By the rotation of the roller piston 1, a compressing chamber 11*a* formed between the roller piston 1 and casing 3 is expanded or contracted by the cooperation of the vane 2. When the compressing chamber 11*a* is expanded, the refrigerant gas of low temperature and low pressure is sucked in together with the lubricating oil around the oil sump in the enclosed container 10. When the compressing chamber 11*a* is contracted, the sucked refrigerant is compressed, and the refrigerant becomes high in temperature and high in pressure, and is discharged from the compressing chamber 11*a*. In this way, the refrigerating cycle of the refrigerant is composed. In part of the refrigerating cycle, a capillary tube (not shown) is installed. The lubricating oil sucked into the compressing chamber 11*a* accompanying the refrigerant is distributed into all area in the compressing chamber 11*a* together with the refrigerant, and lubricates between the surfaces of the contact members (vane 2 and roller piston 1). Not limited to the inside of the compressing chamber 11*a* of the compressing mechanism 1, the lubricating oil also permeates into all contact portions in the enclosed container 1, and lubricates these contact portions.

In the case of compressor of rotary type as in embodiment 1, the contact portions between the tip 2*a* of the vane 2 and the outer periphery 1*a* of the roller piston 1 are particularly likely to wear, and abrasion of this contact area is a problem.

In the embodiment, the lubricating oil contains an ester compound oil and at least one additive selected from the group consisting of phosphoric acid triester, phosphite, phosphoric acid diester, and phosphoric acid monoester. This constitution can prevent decline of lubricity of HFC refrigerant, prevent formation of hydrogen due to hydrolysis of ester compound oil, and prevent occurrence of hydrogen brittleness and stress corrosion. Moreover, such phosphorus compound exhibits an action as extreme pressure additive, and enhances the lubricity of HFC refrigerant.

Furthermore, the hardness difference between the surface of the roller piston 1 and the surface of the vane 2 is designed to be 10 or more in Rockwell hardness (HRC). As a result, the member of smaller hardness assures the normal wear resistance by the ordinary hardness, while the hardness of the other member is 10 or more in HRC than usual, so that the wear resistance can be enhance more than in the prior art. That is, the wear resistance of the necessary area of the metal contact portions is enhanced.

In particular, preferably, the hardness difference between the surface of the roller piston 1 and the surface of the vane 2 should be 10 or more in Rockwell hardness (HRC) , and, at the same time, the lubricating oil should contain an ester compound oil and at least one additive selected from the group consisting of phosphoric acid triester, phosphite, phosphoric acid diester, and phosphoric acid monoester. This constitution gets rid of the demerit of accelerating the wear of the contact member of smaller hardness by the contact member of the greater hardness. Moreover, the phosphorus compound such as phosphoric acid triester, phosphite, phosphoric acid diester, and phosphoric acid monoester exhibits the action as extreme pressure additive, and compensates for shortage of lubrication of chlorine-free composition of HFC refrigerant. Further, by suppressing the hydrolysis of ester compound oil, the surface of the contact member having smaller hardness can hardly have effects of corrosion. Accordingly, the abrasion of both contact portions, that is, the contact member having greater hardness and the contact member having smaller hardness can be extremely decreased. Still more, formation of metal soap due to hydrolysis of ester compound oil can be prevented, thereby eliminating the defect of clogging of capillary tube of refrigerating cycle by deposit of sludge caused by metal soap.

As described herein, according to the constitution of the embodiment, the compressor for refrigerating machine having a high refrigerating performance and a high reliability is obtained.

The embodiment is further specifically described below. One of the roller piston 1 and vane 2 is made of cast iron or sintered iron, and the other has a hardness higher than that of the cast iron or sintered iron by 10 or more in HRC. The member having higher hardness include cemented carbide cast iron, high-speed steel, had chrome cast iron, and other carbide materials. It is formed of cermet, cemented carbide, or other nonferriferous metal. Methods for enhancing the hardness of other member include various methods as follows. Sintered iron or cast iron is treated by hardening, steam treatment, gas nitrocarburizing, carbonitriding, or other surface treatment. Stainless steel is treated by ion nitriding. Ferriferous materials are coated with nonferriferous metal such as chromium nitride by PVD surface treatment. Other known had materials or surface hardening treatments may be applied.

Figure 2:
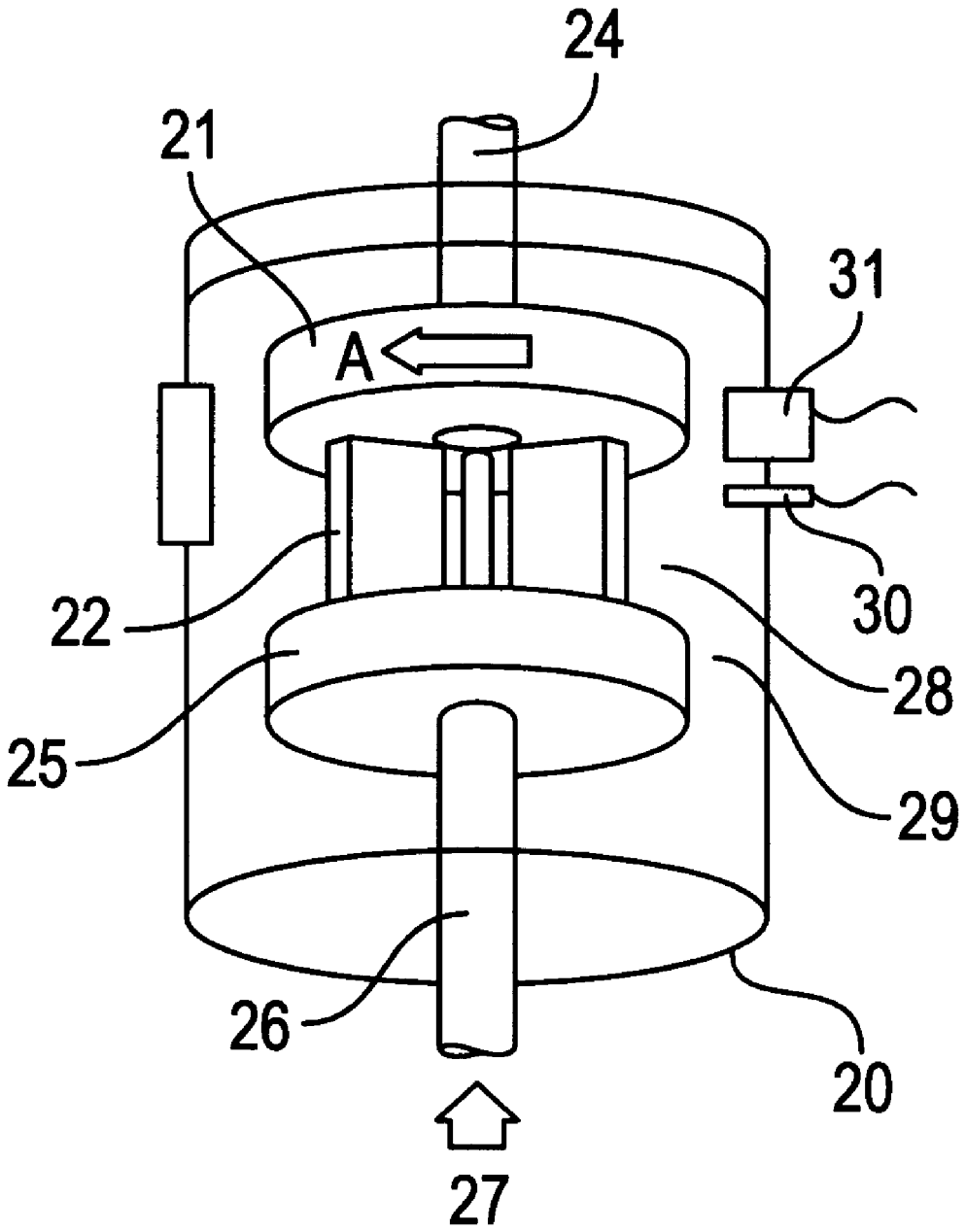
FIG. 2 is a schematic diagram showing a high pressure atmospheric frictional testing machine for frictional test of contact portions of the compressor of the invention.

The abrasion experiment of contact members used in the embodiment was conducted by using a high pressure atmospheric abrasion tester as shown in FIG. 2. In FIG. 2, a disk 21 and a test vane 22 are placed in an enclosed container 20. The enclosed container is filled with refrigerant 29 and lubricating oil 28 containing additives. The abrasion testing condition is shown in Table 1. The disk 21 is coupled to a drive shaft 24, and rotates in the direction of arrow A. At specified positions of the enclosed container 20, a thermometer 30 and a viscometer 31 are installed. The disk 21 is made of a same material as the roller piston 1 for composing the compressing mechanism of the compressor. The lubricating oil was ester compound oil.

TABLE 1

| Refrigerant | R134a | |
|---|---|---|
| Oil temperature | 110 | degrees C. |
| Container internal pressure | 1.42 | MPa |
| Load | 1.47 | KN |
| Rotating speed | 500 | $min^{-1}$ |
| Test duration | 13 | h |

Figure 3:
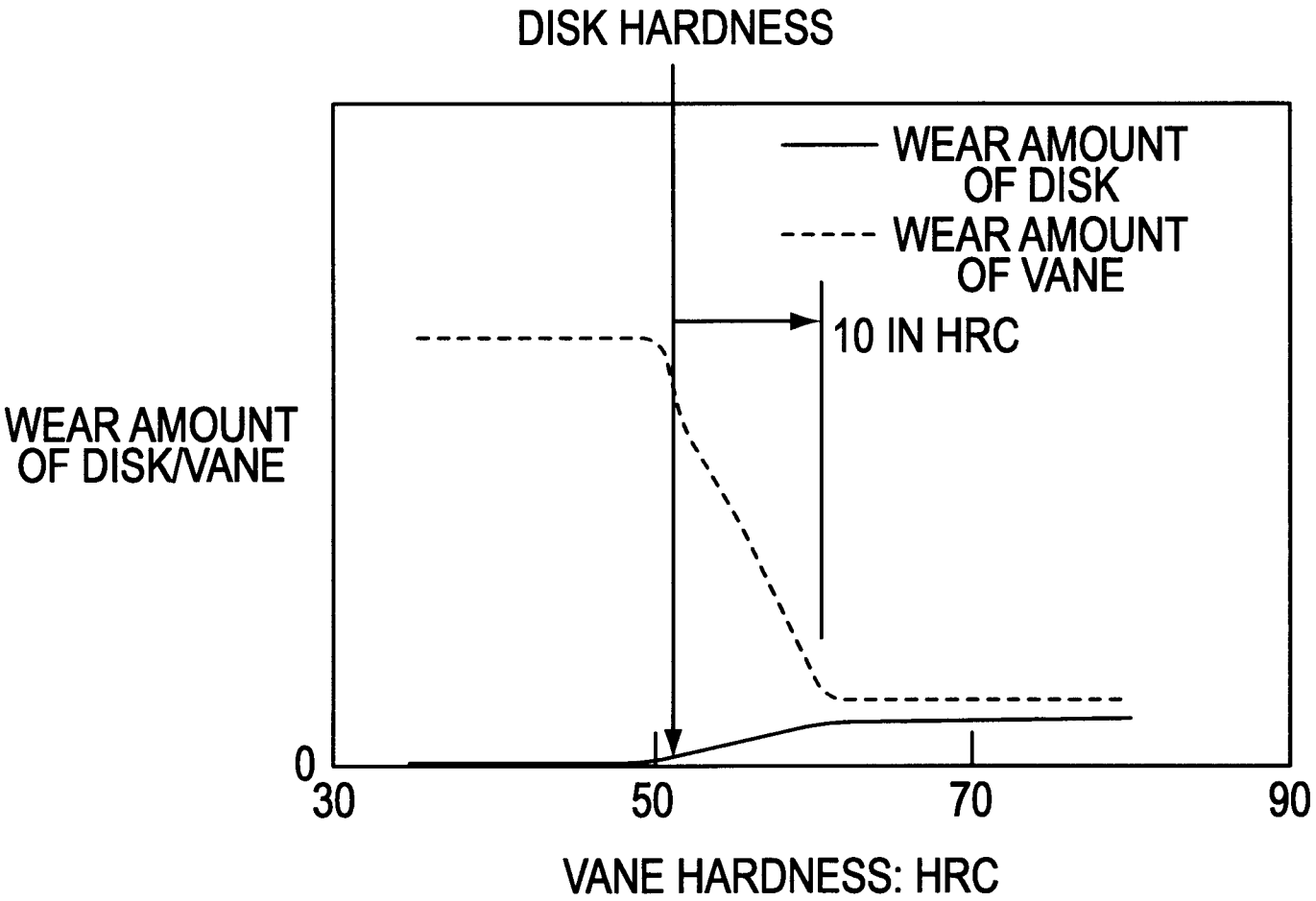
FIG. 3 is a graph showing test results of the relation of hardness and wear of contact portions by the testing machine in FIG. 2.

On the basis of the test result above, the wear amount in an actual compressor was calculated. The wear amount of the contact members in actual compressor in about 500 hours is shown in FIG. 3. In FIG. 3, the axis of abscissas denotes the hardness of the vane 22, and the axis of ordinates represents the amount of wear of the disk corresponding to the roller piston 1 and the vane 22. The hardness of the disk 21 is 51 HRC. The hardness of the vane 22 was changed in various steps in the experiment. As known from FIG. 3, when the hardness of the vane 22 is lower than that of the vane 21 by 10 or more in HRC, the wear of the disk 21 is small, but the wear of the vane 22 is notable. On the other small, but the wear of the vane 22 is notable. On the other hand, when the hardness of the vane 22 is greater than that of the disk 21 by 10 or more in HRC, the wear of the vane 22 is small, and the wear of the disk 21 is as small as in the existing material.

Using the testing machine in FIG. 2, moreover, effects of lubricating oil on the wear of vane 22 and disk 21 (corresponding to piston 1) were also investigated. The lubricating oil was Viscosity Grade 69 of ester compound oil composed of branch type fatty acid and pentaerythritol. The moisture content of the ester compound oil was adjusted to 10 ppm or less in order to prevent hydrolysis. As the extreme pressure additive, a phosphorus compound such as phosphoric acid triester, phosphite, phosphoric acid diester, and phosphoric acid monoester was used, and the content of the extreme pressure additive was 0.03 wt.% to 3 wt.% of the entire lubricating oil. Other additives were not contained in the lubricating oil.

Results of abrasion test investigating the relation between the moisture in the ester compound oil and wear are shown in Table 2. In this experiment, extreme pressure additives were not contained in the lubricating oil.

TABLE 2

| | | — | Vacuum heating |
|---|---|---|---|
| Moisture in material | | High | Low |
| Wear | Vane | 21.1 | 23.5 |
| | Disk | 0.10 | 0.35 |
| Surface roughness | Vane | 0.09 | 1.00 |
| | Disk | 0.15 | 0.80 |
| Coefficient of abrasion | | 0.035 | 0.059 |

Vacuum heating in Table 2 is the treatment for removing moisture contained in the ester compound oil. When the ester compound oil dehydrated by vacuum heating is used, the wear depth, surface roughness, and coefficient of abrasion of the disk 21 are increased. Summing up the result of the experiment by using striebeck curve, it is known that the mixed lubricating state has been shifted to the severer boundary lubricating state. The striebeck curve is a curve representing the relation between the coefficient of abrasion $\mu$ and the striebeck parameter $\eta/VW$, where $\eta$ is the viscosity, V is the velocity, and W is the load. As a result of FT-IR analysis of the deposit around the vane 22, a small amount of iron soap compound was identified.

Thus, as known from this result of experiment, when dehydrated ester compound oil is used, chemical wear which is one of the causes of abrasion is estimated to be transferred from -hydrolysis to formation of iron soap due to pyrolysis at high temperature.

Figure 4:
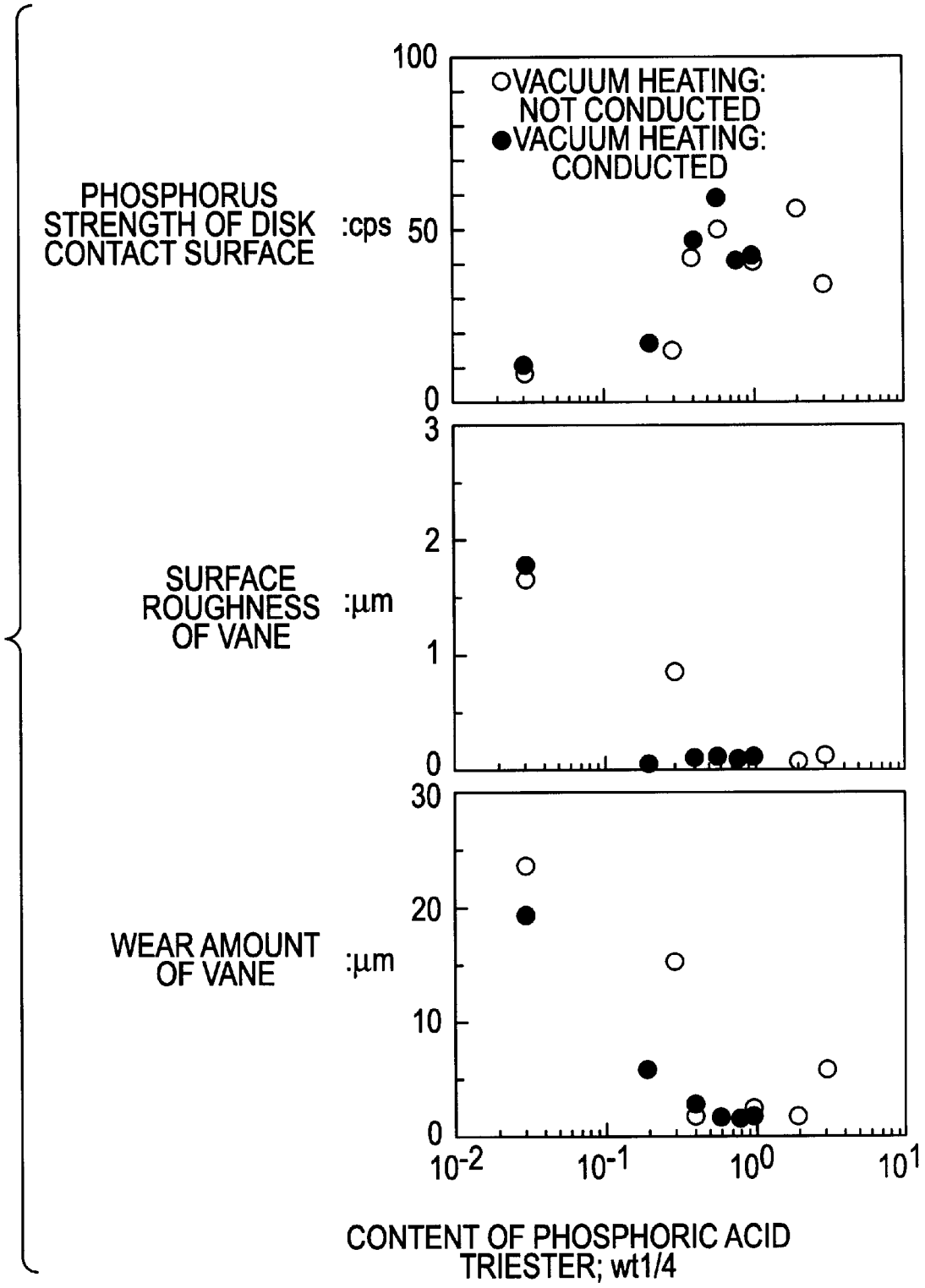
FIG. 4 is a graph showing: test results of addition amount characteristic of phosphoric acid triester by the testing machine in FIG. 2.

Next, using a lubricating oil adding phosphoric acid triester to the ester compound oil, an abrasion test was conducted to investigate the relation between the moisture in the lubricating oil and effect of addition of phosphoric acid triester. Depending on the content of the phosphoric acid triester, the wear amount and surface roughness of the vane 22, and surface phosphorus strength of the disk 21 are shown in FIG. 4. The phosphorus strength of the contact surface of the disk 21 was measured by using EPMA.

In FIG. 4, the axis of abscissas denotes the rate of addition of phosphoric acid triester (wt.%) in the ester compound oil. Regardless of the moisture content, at the content of phosphoric acid triester of 0.2 wt.% or more, the abrasion of the vane 22 decreased, and the effect for preventing wear was notably expressed. The wear amount of the vane 22 and the phosphorus strength of contact surface of the disk 21 did not change depending on the moisture content. This result of experiment shows the great effect of the content of the phosphoric acid triester for preventing abrasion of contact members. In this case, it is estimated that the phosphorus compound generated by pyrolysis of phosphoric acid triester acts on the contact surface to decrease the wear. In this case, possibility of hydrolysis is estimated to be low.

Figure 5:
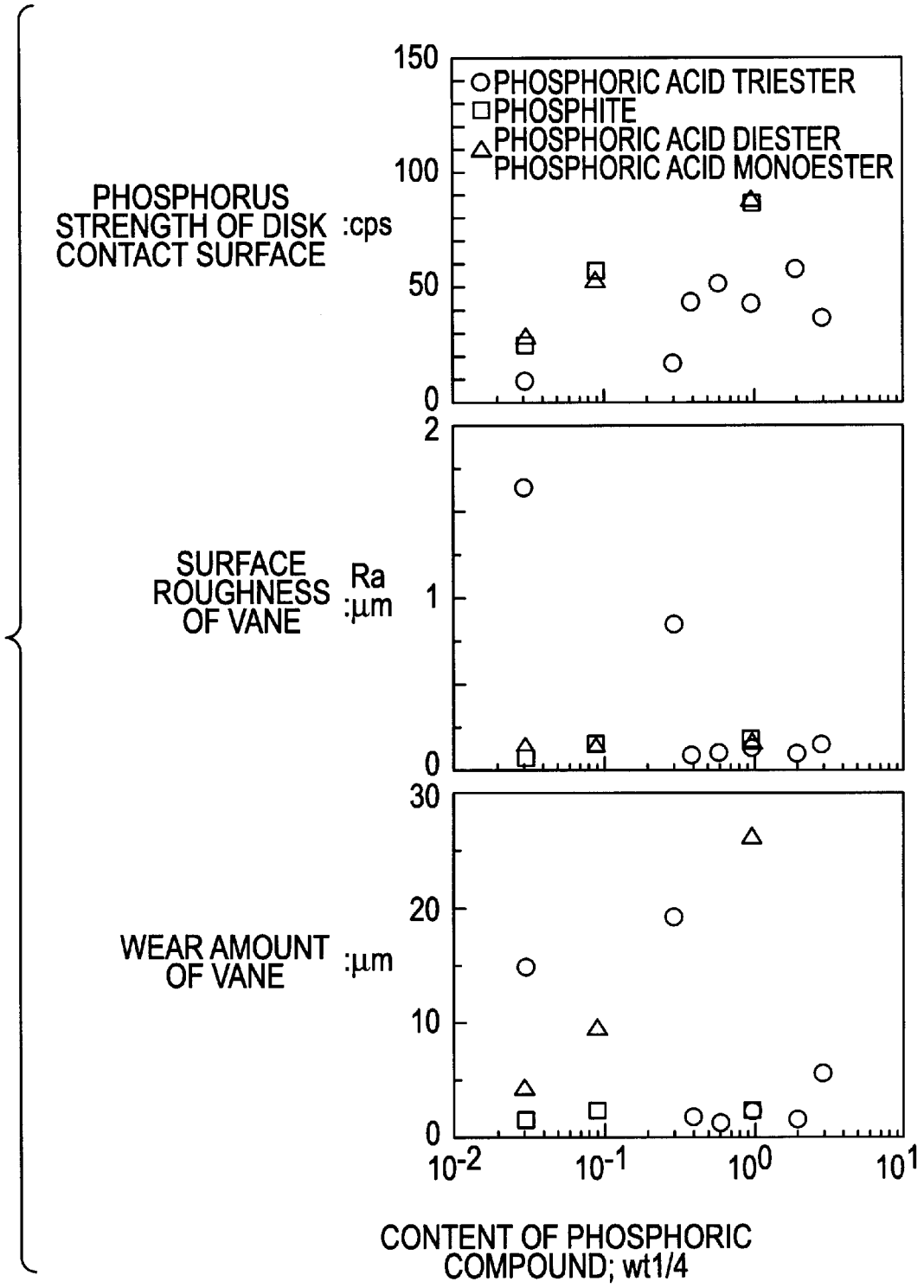
FIG. 5 is a graph showing test results of addition amount characteristic of phosphorus compound extreme pressure additive by the testing machine in FIG. 2.

When moisture is contained in the ester compound oil, effects of addition of extreme pressure additives in various phosphorus compounds were investigated. Results of this abrasion test are shown in FIG. 5. In FIG. 5, when using phosphoric acid triester, the phosphorus strength of the contact surface of the disk 21 reaches the saturation at the content of about 0.2 wt.% to 0.3 wt.%. When using phosphite, phosphoric acid diester or phosphoric acid monoester having high reactivity, the phosphorus strength of the contact surface of the disk 21 tends to increases as the content is increased. In the content range of 0.2 wt.% to 3.0 wt.% of phosphoric acid triester, the wear is small and stable. At the content of 0.09 wt.% or less of phosphite, the wear of the vane 22 is small. At the content of 0.03 wt.% or less of phosphoric acid diester or phosphoric acid monoester, the wear of the vane 22 is small. The lubricating oil in the composition containing 0.09 wt.% or less of phosphite, or 0.03 wt.% or less of phosphoric acid diester or phosphoric acid monoester is greater in the wear amount of the contact members as compared with the lubricating oil containing 0.4 wt.% or more of phosphoric acid triester. As known from this result of experiment, in the content range of 0.2 wt.% to 3.0 wt.% of phosphoric acid triester, an excellent wear preventive effect is obtained for a long period. On the other hand, at the content of 0.09 wt.% or less of phosphite, a short-term wear preventive effect such as promotion of initial fitting is obtained. At the content of 0.03 wt.% or less of phosphoric acid diester or phosphoric acid monoester, a short-term wear preventive effect such as promotion of initial fitting is obtained.

Figure 6:
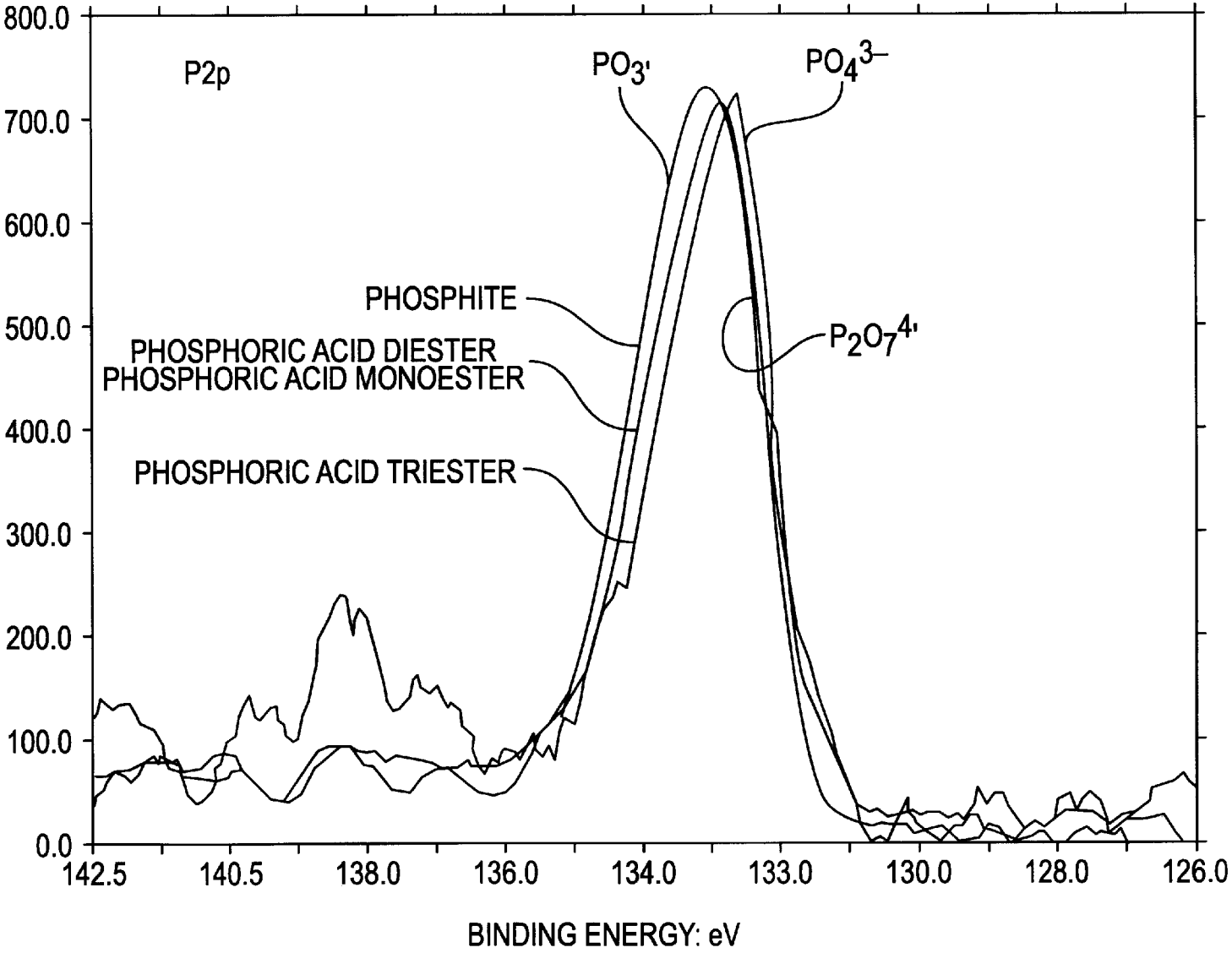
FIG. 6 is a graph showing difference in X-ray photoelectron spectra of contact surfaces when tested by adding phosphoric acid triester, phosphite, phosphoric acid diester, and phosphoric acid monoester, by the testing machine in FIG. 2.

In the experiment using ester compound oil containing phosphoric acid triester, phosphite, phosphoric acid diester, or phosphoric acid monoester, the XPS analysis was conducted on the phosphorus compound on the contact surface of the disk 21, of which results are summarized in FIG. 6. In FIG. 6, when using various phosphorus compounds, phosphate was confirmed on the surface of the disk 21. That is, phosphate was produced, and it is known that the phosphate prevents wear. As the phosphoric acid diester or phosphoric acid monoester, a compound of solid structure having high possibility of being absorbed more on the metal surface as compared with phosphite was used. At the tip **2*a* of the vane 22** generating high temperature, chemical wear is promoted, and much phosphate is produced, and hence it is estimated that the wear is increased. As a common effect obtained by production of phosphate, decrease of surface roughness was confirmed. However, the wear amount varied with the chemical structure of the phosphorus extreme pressure additives, and the wear preventive effect was not always obtained.

In embodiment 1, HFC is not particularly limited, but, for example, a compound composed of hydrogen, fluorine and carbon not having chlorine atom in the chemical structural formula is used. The ester compound oil is not particularly limited, oil containing ester compound generally used as lubricating oil such as polyol ester oil or diester oil is used.

The phosphoric acid triester is not particularly limited, but, for example, triphenyl phosphate or tricresyl phosphate may be used.

The phosphite is not particularly limited, but, for example, triphenyl phosphite, diphenyl phosphite, or dibutyl phosphite may be used.

The phosphoric acid monoester or phosphoric acid diester is not particularly limited, but, for example, butyl phosphate or diphenyl phosphate may be used.

In short, the above may be summarized as follows.

(1) When dehydrated ester compound oil is used as lubricating oil, chemical wear of contact member is mainly derived from generation of iron soap by pyrolysis of ester compound.

(2) An ester compound oil containing an extreme pressure additive of phosphorus compound relates to abrasion by formation of phosphate by pyrolysis of its phosphorus compound. In this case, the contact surface of the contact member is smooth, but the wear preventive effect and the adequate addition depend significantly on the chemical structure of the phosphorus compound.

(3) Of the lubricating oil containing ester compound oil and phosphoric acid triester (TPP, TCP, etc.), the content X (wt.%) of the phosphoric acid triester is particularly preferred in the range shown in formula (1).

$$0.2 \leqq X < 3.0 \quad (1)$$

By containing the phosphoric acid triester in the range in formula (1), the effect of preventing abrasion of contact members is extremely excellent even in the presence of ester compound oil of strong polarity. As a result, the refrigerating performance and reliability of the refrigerating compressor are further enhanced for a long period.

(4) The content of the phosphite preferred to be added in the lubricating oil containing ester compound oil and phosphite is 0.09 wt.% or less, and in the range of this content, a particularly excellent wear preventive effect is exhibited. This phosphite exhibits its effect only in the initial phase of operation of the refrigerating compressor, and improves the fitting of the contact portions and enhances hances the lubricity. Afterwards, it further prevents effects by acid on the ester compound oil. Therefore, without causing other problems, it improves the initial lubricating performance of the contact portions. At the same time, it prevents wear of the contact portions in the initial phase of operation when abrasion is likely to occur. As a result, the refrigerating performance and reliability of the refrigerating compressor may be further enhanced.

(5) The content of the phosphoric acid monoester or phosphoric acid diester preferred to be added in the lubricating oil containing ester compound oil and phosphoric acid monoester or phosphoric acid diester is 0.03 wt. % or less, and in the range of this content, a particularly excellent wear preventive effect is exhibited. This phosphoric acid monoester or phosphoric acid diester exhibits its effect only in the initial phase of operation of the refrigerating compressor, and improves the fitting of the contact portions and enhances the lubricity. Afterwards, it further prevents effects by acid on the ester compound oil. Therefore, without causing other problems, it improves the initial lubricating performance of the contact portions. At the same time, it prevents wear of the contact portions in the initial phase of operation when abrasion is likely to occur. As a result, the refrigerating performance and reliability of the refrigerating compressor may be further enhanced.

(6) The lubricating oil adding phosphoric acid triester and phosphite to an ester compound oil exhibits the action and effect mentioned in (3) and (4) synergistically, and further excellent effects are obtained.

(7) The lubricating oil adding phosphoric acid triester and phosphoric acid monoester or phosphoric acid diester to an ester compound oil exhibits the action and effect mentioned in (3) and (5) synergistically, and further excellent effects are obtained.

EMBODIMENT 2

Using the same HFC refrigerant as in embodiment 1, a lubricating oil adding phosphoric acid triester and acid capturing agent to an ester compound oil was used, and the wear of contact members was investigated same as in embodiment 1. As the acid capturing agent, an epoxy compound (AC) was used. The results of experiment were compared with theoretical calculation. As a result, the content X (wt.%) of the phosphoric acid triester in the lubricating oil containing ester compound oil, phosphoric acid triester, and acid capturing agent is preferred to be in the range specified in formula (2), supposing the content of AC to be Y (wt. %).

$$3+Y\times0.714>X\geqq0.2+Y\times0.714 \quad \ldots (2)$$

By containing the acid capturing agent in the range of formula (2). hydrolysis by moisture in the ester compound oil can be suppressed to maximum. It is moreover possible to decrease total oxidation, so that deterioration of lubricating oil can be prevented without causing other problems. Hence, wear of contact members in contact portions is extremely decreased, and an excellent lubricating performance can be maintained for a long period. Moreover, it sufficiently prevents problems such as lowering of insulating or sealing performance due to corrosion of organic materials, such as insulating material and seal material of the motor, installed in the enclosed container together with the compressing mechanism, by organic acids. As a result, the refrigerating performance and reliability of the compressor may be further enhanced.

In the foregoing formula (2), supposing the content of the acid capturing agent to be Y (wt.%), the relation between the content Y of the acid capturing agent and the content X of the phosphoric acid triester is preferred to be as shown in formula (3).

$$Y\leqq1.4(X-0.2) \quad (3)$$

EMBODIMENT 3

Using the same HFC refrigerant as in embodiment 1, a lubricating oil adding phosphoric acid triester and antioxidant to an ester compound oil was used, and the wear of contact members was investigated same as in embodiment 1. As the antioxidant, a phenol compound (OC) was used. The results of experiment were compared with theoretical calculation. As a result, the content X (wt.%) of the phosphoric acid triester in the lubricating oil containing ester compound oil, phosphoric acid triester, and antioxidant is preferred to be in the range specified in formula (4), supposing the content of the antioxidant to be Z (wt.%).

$$3+Z\times0.333>X\geqq0.2+Z\times0.333 \quad (4)$$

By containing the antioxidant in the range of formula (4), oxidation of lubricating agent due to dissolved oxygen in the lubricating oil can be prevented without causing other problems. Hence, wear of contact members in contact portions is extremely decreased, and an excellent lubricating performance can be maintained for a long period. As a result, the refrigerating performance and reliability of the compressor may be further enhanced.

In the formula (4), the relation between the content Z of the antioxidant and the content X of the phosphoric acid triester is preferred to be in a range as shown in formula (5).

$$Z \leqq 3(X-0.2) \quad (5)$$

EMBODIMENT 4

Using the same HFC refrigerant as in embodiment 1, a lubricating oil adding phosphoric acid triester, acid capturing agent and antioxidant to an ester compound oil was used, and the wear of contact members was investigated same as in embodiment 1. As the acid capturing agent, an epoxy compound (AC) was used. As the antioxidant, a phenol compound (OC) was used. The results of experiment were compared with theoretical calculation. As a result, the content X (wt.%) of the phosphoric acid triester in the lubricating oil containing ester compound oil, phosphoric acid triester, acid capturing agent and antioxidant is preferred to be in the range specified in formula (6), supposing the content of the acid capturing agent to be Y (wt.%) and the content of the antioxidant to be Z (wt.%).

$$3+Y\times0.714+Z\times0.333 > X \geqq 0.2+Y\times0.714+Z\times0.333 \quad (6)$$

By containing the acid capturing agent and antioxidant in the range of formula (6), effects explained in embodiment 3 and embodiment 4 are obtained at the same time.

In the foregoing embodiments 1 to 4, if the composition of the lubricating oil is out of the ranges specified in formulas (1) to (6), the individual effects are slightly inferior.

EMBODIMENT 5

In embodiment 5, the refrigerant was HFC same as in embodiment 1 and embodiment 3. The principal component of the lubricating oil is ether compound oil. Moreover, as the extreme pressure additive, at least one compound selected from the group consisting of phosphoric acid triester, phosphite, phosphoric acid diester, and phosphoric acid monoester was used. Acid capturing agent was not contained. Using the lubricating oil containing such principal component and additive, the same experiment as in embodiment 1 and embodiment 3 was conducted. The other constitution is same as in embodiment 1 and embodiment 3, and duplicated illustrations and descriptions are omitted. When using the lubricating oil containing ether compound oil and the phosphorus compound, an excellent lubricating effect was observed. Formation of metal soap was suppressed. Moreover, clogging of capillary tube due to sludge was suppressed. Still more, surface corrosion of contact portions was suppressed. In particular, in this embodiment, it was found that excellent effects were obtained if the hardness difference of two contact members in the contact portions is not more than 10 in HRG. That is, if the hardness is nearly equal between the contact members composing the contact portions of the compressing mechanism, or if the lubricating oil does not contain acid capturing agent, by the action of the ether compound oil and phosphorus compound as extreme pressure additive, it is possible to compensate for shortage of lubrication of chlorine-free refrigerant, and at the same time, corrosion of contact members and clogging of refrigerating cycle can be prevented. As a result, the compressor having practicable refrigerating performance and reliability was obtained. Further, when the antioxidant is added, the effects are notably enhanced. Of course, in embodiment 5, as required, it is also possible to set the hardness difference of contact members composing the contact portions of the compressing mechanism can be set at 10 or more in HRC. In this constitution, the same actions and effects as in embodiment 1 and embodiment 3 can be exhibited simultaneously, and the refrigerating performance and reliability of the compressor are outstandingly enhanced. As the ether compound oil, although not limited particular, for example, polyvinyl ether oil, polyalkylene glycol oil, or polyphenyl ether oil may be used.

EMBODIMENT 6

In embodiment 6, the refrigerant was HFC same as in embodiment 1 and embodiment 3. The principal component of the lubricating oil is carbonate compound oil. Moreover, as the extreme pressure additive, at least one compound selected from the group consisting of phosphoric acid triester, phosphite, phosphoric acid diester, and phosphoric acid monoester was used. Acid capturing agent was not contained. Using the lubricating oil containing such principal component and additive, the same experiment as in embodiment 1 and embodiment 3 was conducted. The other constitution is same as in embodiment 1 and embodiment 3, and duplicated illustrations and descriptions are omitted.

When using the lubricating oil containing carbonate compound and the phosphorus compound, an excellent lubricating effect was observed. Formation of metal soap was suppressed. Moreover, clogging of capillary tube due to sludge was suppressed. Still more, surface corrosion of contact portions was suppressed. In particular, in this embodiment, it was found that excellent effects were obtained if the hardness difference of two contact members in the contact portions is not more than 10 in HRC.

That is, if the hardness is nearly equal between the contact members composing the contact portions of the compressing mechanism, or if the lubricating oil does not contain acid capturing agent, by the action of the carbonate compound oil and phosphorus compound as extreme pressure additive, it is possible to compensate for shortage of lubrication of chlorine-free refrigerant, and at the same time, corrosion of contact members and clogging of refrigerating cycle can be prevented. As a result, the compressor having practicable refrigerating performance and reliability was obtained. Further, when the antioxidant is added, the effects are notably enhanced. Of course, in embodiment 6, as required, it is also possible to set the hardness difference of contact members composing the contact portions of the compressing mechanism can be set at 10 or more in HRC. In this constitution, the same actions and effects as in embodiment 1 and embodiment 3 can be exhibited simultaneously, and the refrigerating performance and reliability of the compressor are outstandingly enhanced.

As the carbonate compound oil, although not limited particular, for example, monocarbonate oil and polycarbonate oil may be used.

What is claimed is:

1. A compressor for refrigerating machine comprising:

an enclosed container, a compressing mechanism having contact portions, being installed in said enclosed container, refrigerant contained in said enclosed container, and lubricating oil compatible with said refrigerant, wherein said refrigerant is a chlorine-free hydrofluorocarbon (HFC), and said lubricating oil contains an ester compound oil and a phosphoric acid triester.

2. A compressor for refrigerating machine of claim 1, wherein said contact portions include a first contact member and a second contact member contacting with said first contact member, and the difference between hardness of surface of said first contact member and hardness of surface of said second contact member is 10 or more in Rockwell hardness (HRC).

3. A compressor for refrigerating machine of claim 2, wherein the content X (wt.%) of said phosphoric acid triester contained in said lubricating oil is in a range of $$0.2 \leqq X < 3.0.$$

4. A compressor for refrigerating machine of claim 2, wherein said lubricating oil further contains an acid capturing agent.

5. A compressor for refrigerating machine of claim 4, wherein said acid capturing agent is an epoxy compound.

6. A compressor for refrigerating machine of claim 2, wherein said lubricating oil further contains Y (wt.%) of acid capturing agent, and the content X (wt.%4) of said phosphoric acid triester is in a range of $$3+Y+0.714>X \geqq 0.2+Y\times 0.714.$$

7. A compressor for refrigerating machine of claim 6, wherein the relation between the content Y (wt. %) of said acid capturing agent and the content X (wt. %) of said phosphoric acid triester is $$Y \leqq 1.4(X-0.2).$$

8. A compressor for refrigerating machine of claim 2, wherein said lubricating oil further contains an antioxidant.

9. A compressor for refrigerating machine of claim 8, wherein said antioxidant is a phenol compound.

10. A compressor for refrigerating machine of claim 2, wherein said lubricating oil further contains Z (wt.%) of antioxidant, and the content X (wt.%) of said phosphoric acid triester is $$3+Z\times 0.333>X \geqq 0.2+Z\times 0.333.$$

11. A compressor for refrigerating machine of claim 10, wherein the relation between the content Z (wt.%) of said antioxidant and the content X (wt.%) of said phosphoric acid triester is $$Z \leqq 3(X-0.2).$$

12. A compressor for refrigerating machine of claim 2, wherein said lubricating oil further contains Y (wt.%) of acid capturing agent of epoxy compound and Z (wt.%) of antioxidant of phenol compound, and the content X (wt. %) of said phosphoric acid triester is in a range of $$3+Y\times 0.714+Z\times 0.333 > X \geqq 0.2+Y\times 0.714+Z\times 0.333.$$

13. A compressor for refrigerating machine comprising:

an enclosed container, a compressing mechanism having contact portions, being installed in said enclosed container, refrigerant contained in said enclosed container, and lubricating oil compatible with said refrigerant, wherein said refrigerant is a chlorine-free hydrofluorocarbon (HFC), and said lubricating oil contains an ester compound oil and a phosphite.

14. A compressor for refrigerating machine of claim 13, wherein said contact portions include a first contact member and a second contact member contacting with said first contact member, and the difference between hardness of surface of said first contact member and hardness of surface of said second contact member is 10 or more in Rockwell hardness (HRC).

15. A compressor for refrigerating machine of claim 14, wherein the content of said phosphite contained in said lubricating oil is 0.09 wt.% or less.

16. A compressor for refrigerating machine comprising:

an enclosed container, a compressing mechanism having contact portions, being installed in said enclosed container, refrigerant contained in said enclosed container, and lubricating oil compatible with said refrigerant, wherein said refrigerant is a chlorine-free hydrofluorocarbon (HFC), and said lubricating oil contains an ester compound oil and at least one phosphorus compound of phosphoric acid diester and phosphoric acid monoester.

17. A compressor for refrigerating machine of claim 16, wherein said contact portions include a first contact member and a second contact member contacting with said first contact member, and the difference between hardness of surface of said first contact member and hardness of surface of said second contact member is 10 or more in Rockwell hardness (HRC).

18. A compressor for refrigerating machine of claim 17, wherein the content of said phosphorus compound contained in said lubricating oil is 0.03 wt.% or less.

19. A compressor for refrigerating machine comprising:

an enclosed container, a compressing mechanism having contact portions, being installed in said enclosed container, refrigerant contained in said enclosed container, and lubricating oil compatible with said refrigerant, wherein said refrigerant is a chlorine-free hydrofluorocarbon (HFC), and said lubricating oil contains an ether compound oil and a phosphoric acid triester.

20. A compressor for refrigerating machine of claim 19, wherein said contact portions include a first contact member and a second contact member contacting with said first contact member, and the difference between hardness of surface of said first contact member and hardness of surface of said second contact member is 10 or more in Rockwell hardness (HRC).

21. A compressor for refrigerating machine of claim 19, wherein the content X (wt.%) of said phosphoric acid triester contained in said lubricating oil is in a range of $$0.2 \leqq X < 3.0.$$

22. A compressor for refrigerating machine of claim 19, wherein said lubricating oil further contains an antioxidant.

23. A compressor for refrigerating machine of claim 22, wherein said antioxidant is a phenol compound.

24. A compressor for refrigerating machine of claim 19, wherein said lubricating oil further contains Z (wt.%) of antioxidant, and the content X (wt.%) of said phosphoric acid triester is $$3+Z\times 0.333>X>0.2+Z\times 0.333.$$

25. A compressor for refrigerating machine of claim 24, wherein the relation between the content Y (wt.%) of said acid capturing agent and the content X (wt.%4) of said phosphoric acid triester is $$Y \leqq 1.4\ (X-0.2).$$

26. A compressor for refrigerating machine comprising:

an enclosed container, a compressing mechanism having contact portions, being installed in said enclosed container, refrigerant contained in said enclosed container, and lubricating oil compatible with said refrigerant, wherein said refrigerant is a chlorine-free hydrofluorocarbon (HFC), and said lubricating oil contains a carbonate compound oil and a phosphoric acid triester.

27. A compressor for refrigerating machine of claim 26, wherein said contact portions include a first contact member and a second contact member contacting with said first contact member, and the difference between hardness of surface of said first contact member and hardness of surface of said second contact member is 10 or more in Rockwell hardness (HRC).

28. A compressor for refrigerating machine of claim 26, wherein the content X (wt.%) of said phosphoric acid triester contained in said lubricating oil is in a range of $$0.2 \leqq X < 3.0.$$

29. A compressor for refrigerating machine of claim 26, wherein said lubricating oil further contains an antioxidant.

30. A compressor for refrigerating machine of claim 29, wherein said antioxidant is a phenol compound.

31. A compressor for refrigerating machine of claim 26, wherein said lubricating oil further contains Z (wt.%) of antioxidant, and the content X (wt. %) of said phosphoric acid triester is $$3+Z\times 0.333 > X \geqq 0.2+Z+0.333.$$

32. A compressor for refrigerating machine of claim 31, wherein the relation between the content Z (wt.%) of said antioxidant and the content X (wt.%) of said phosphoric acid triester is $$Z \leqq 0.3(X-0.2).$$

33. A compressor for refrigerating machine comprising:

an enclosed container, a compressing mechanism having contact portions, being installed in said enclosed container, refrigerant contained in said enclosed container, and lubricating oil compatible with said refrigerant, wherein said refrigerant is a chlorine-free hydrofluorocarbon (HFC), and said lubricating oil contains an ether compound oil and a phosphite.

34. A compressor for refrigerating machine of claim 33, wherein said contact portions include a first contact member and a second contact member contacting with said first contact member, and the difference between hardness of surface of said first contact member and hardness of surface of said second contact member is 10 or more in Rockwell hardness (HRC).

35. A compressor for refrigerating machine of claim 33, wherein the content of said phosphite contained in said lubricating oil is 0.09 wt.% or less.

36. A compressor for refrigerating machine comprising:

an enclosed container, a compressing mechanism having contact portions, being installed in said enclosed container, refrigerant contained in said enclosed container, and lubricating oil compatible with said refrigerant, wherein said refrigerant is a chlorine-free hydrofluorocarbon (HFC), and said lubricating oil contains a carbonate compound oil and a phosphite.

37. A compressor for refrigerating machine of claim 36, wherein said contact portions include a first contact member and a second contact member contacting with said first contact member, and the difference between hardness of surface of said first contact member and hardness of surface of said second contact member is 10 or more in Rockwell hardness (HRC).

38. A compressor for refrigerating machine of claim 36, wherein the content of said phosphite contained in said lubricating oil is 0.09 wt.% or less.

39. A compressor for refrigerating machine comprising:

an enclosed container, a compressing mechanism having contact portions, being installed in said enclosed container, refrigerant contained in said enclosed container, and lubricating oil compatible with said refrigerant, wherein said refrigerant is a chlorine-free hydrofluorocarbon (HFC), and said lubricating oil contains an ether compound oil and at least one phosphorus compound of phosphoric acid diester and phosphoric acid monoester.

40. A compressor for refrigerating machine of claim 39, wherein said contact portions include a first contact member and a second contact member contacting with said first contact member, and the difference between hardness of surface of said first contact member and hardness of surface of said second contact member is 10 or more in Rockwell hardness (HRC).

41. A compressor for refrigerating machine of claim 39, wherein the content of said phosphorus compound contained in said lubricating oil is 0.03 wt.% or less.

42. A compressor for refrigerating machine comprising:

an enclosed container, a compressing mechanism having contact portions, being installed in said enclosed container, refrigerant contained in said enclosed container, and lubricating oil compatible with said refrigerant, wherein said refrigerant is a chlorine-free hydrofluorocarbon (HFC), and said lubricating oil contains a carbonate compound oil and at least one phosphorus compound of phosphoric acid diester and phosphoric acid monoester.

43. A compressor for refrigerating machine of claim 42, wherein said contact portions include a first contact member and a second contact member contacting with said first contact member, and the difference between hardness of surface of said first contact member and hardness of surface of said second contact member is 10 or more in Rockwell hardness (HRC).

44. A compressor for refrigerating machine of claim 42, wherein the content of said phosphorus compound contained in said lubricating oil is 0.03 wt.% or less.

* * * * *

UNITED STATES PATENT AND TRADEMARK OFFICE

CERTIFICATE OF CORRECTION

PATENT NO. : 5,966,949

DATED : October 19, 1999

INVENTOR(S) : Futagami et al.

It is certified that error appears in the above-identified patent and that said Letters Patent is hereby corrected as shown below:

Claim 6, line 3, change "(wt.%4)" to --(wt.%)--.

Claim 24, line 5, in the formula, change ">" to --≥--.

Claim 25, line 3, change "(wt.%4)" to --(wt.%)--.

Signed and Sealed this

First Day of August, 2000

*Attest:*

Q. TODD DICKINSON

*Attesting Officer*

*Director of Patents and Trademarks*